United States Patent [19]

Diamant

[11] 3,942,206

[45] Mar. 9, 1976

[54] METHOD OF MAKING SHOES

[76] Inventor: Frederick J. Diamant, 40 E. 83rd St., New York, N.Y. 10028

[22] Filed: Feb. 24, 1975

[21] Appl. No.: 552,394

[52] U.S. Cl. ..... 12/142 R
[51] Int. Cl.[2] ..... A43D 9/00
[58] Field of Search ..... 12/142 R, 142 D, 142 C

[56] References Cited

UNITED STATES PATENTS

| | | | |
|---|---|---|---|
| 2,212,516 | 8/1940 | Engel | 12/142 R |
| 2,673,406 | 3/1954 | Glassman | 12/142 D |
| 3,354,487 | 11/1967 | Glassman | 12/142 R |

*Primary Examiner*—Patrick D. Lawson
*Attorney, Agent, or Firm*—Seidel, Gonda & Goldhammer

[57] ABSTRACT

A mud guard is stitched to an upper at or spaced from the lower edge of the upper. A portion of the periphery of a sock lining is stitched to the lower edge of the upper but is free from attachment with respect to the heel portion of the upper. An inner sole or platform containing a metal shank is bonded to the sock lining. Then a free edge portion of the mud guard as well as a heel flange are lasted in overlying relation to the inner sole. Thereafter, an outsole is attached to the inner sole in overlying relation to the heel flange and mud guard.

12 Claims, 16 Drawing Figures

FIG. 1
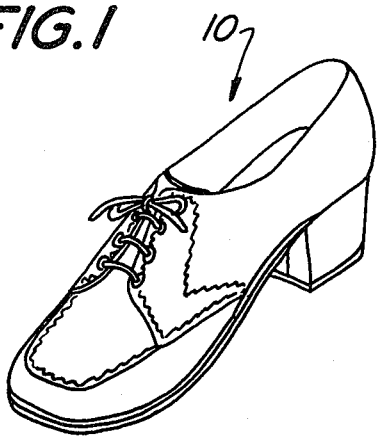
FIG. 2
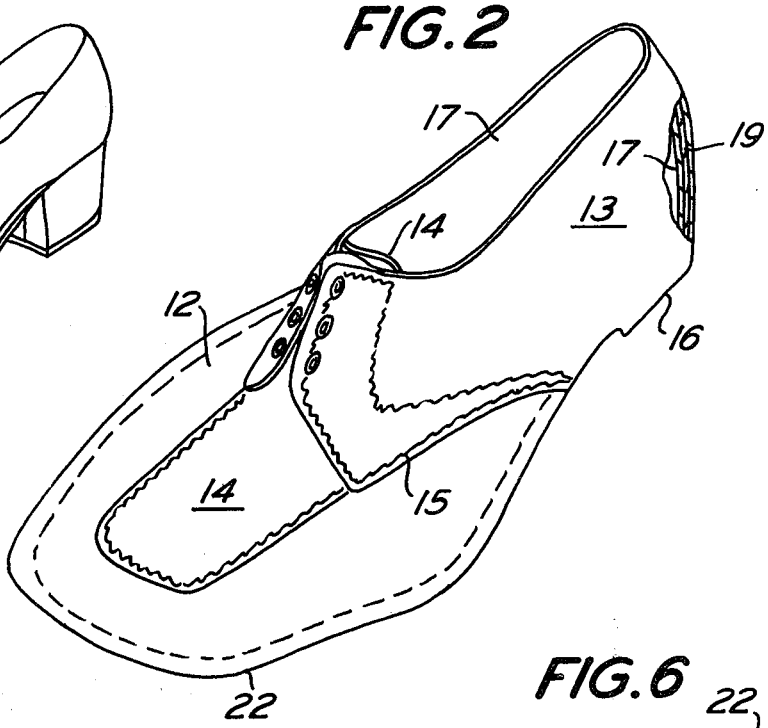
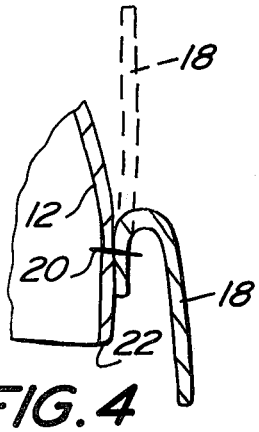
FIG. 4
FIG. 6
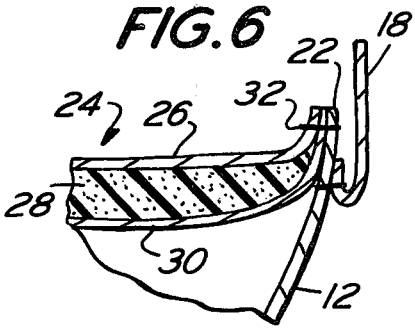
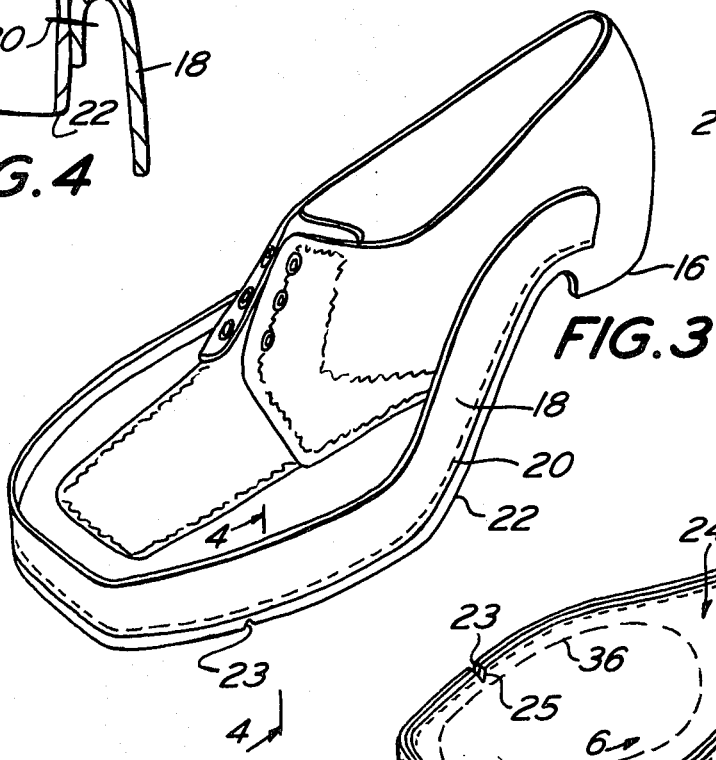
FIG. 3
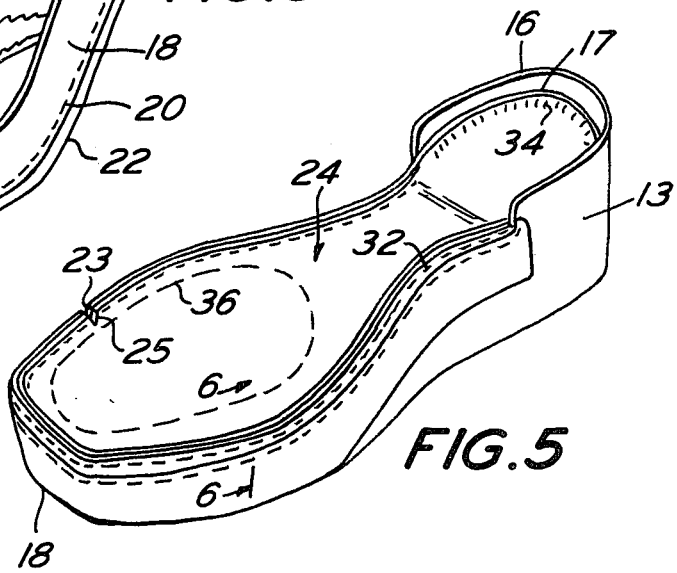
FIG. 5

FIG.7
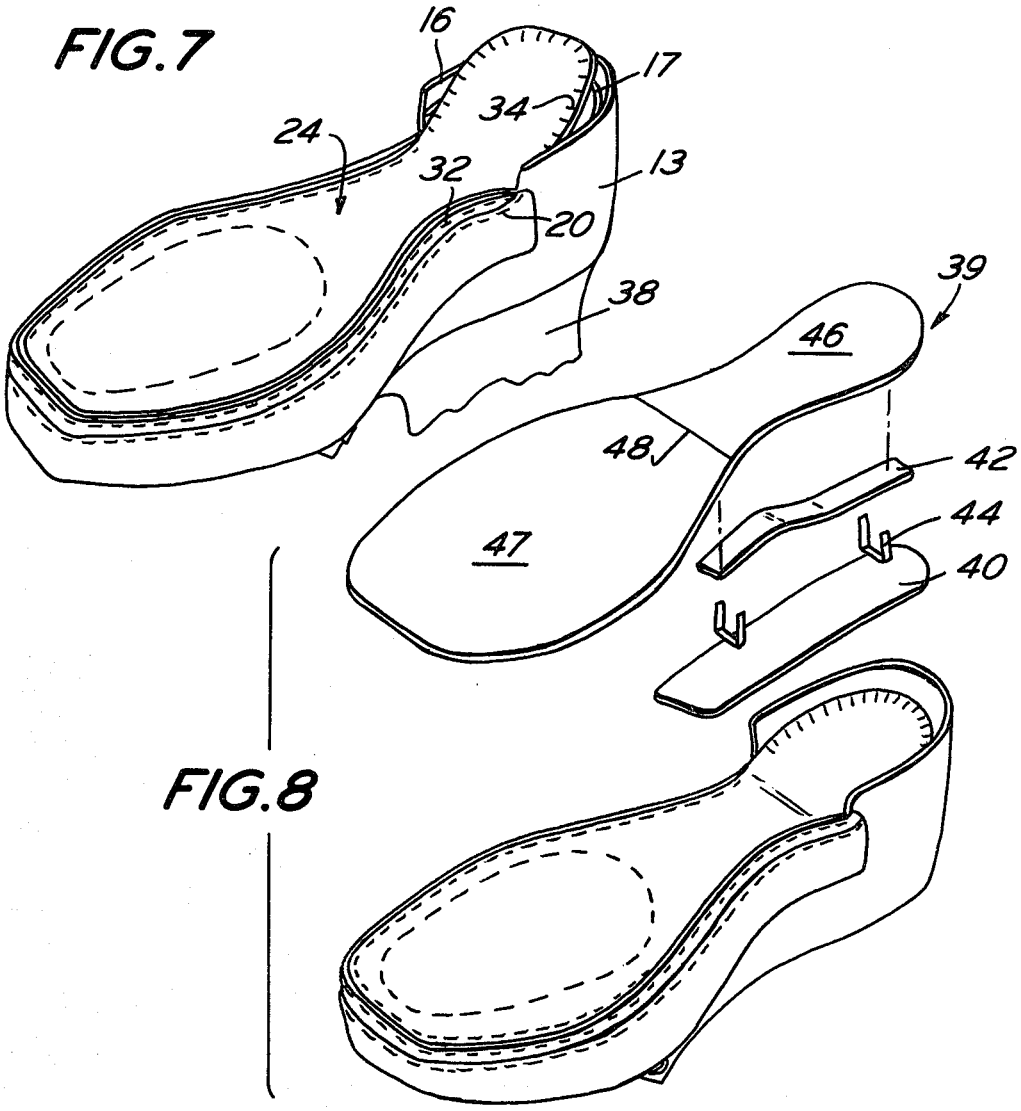
FIG.8
FIG.9
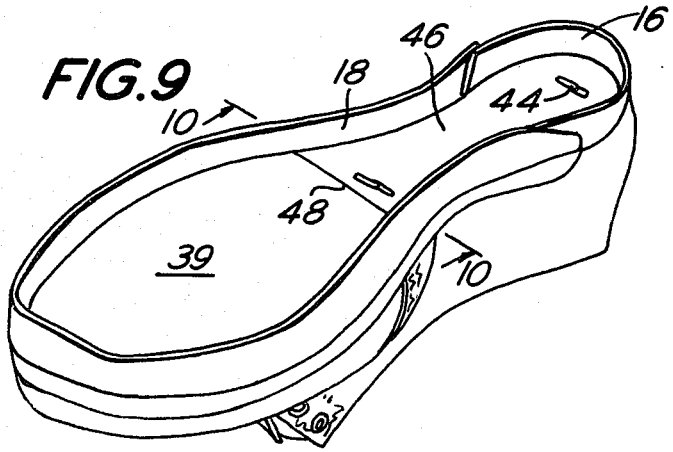
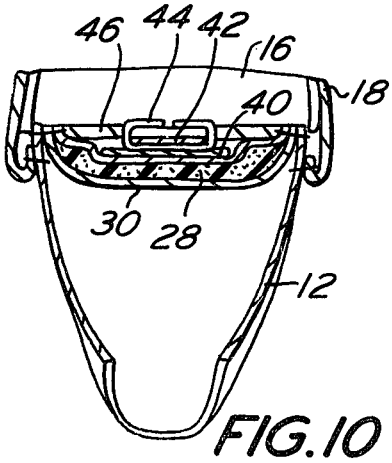
FIG.10

FIG. 11
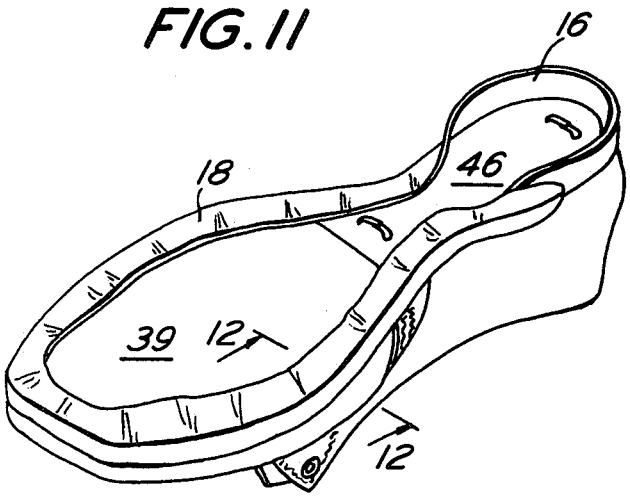
FIG. 12
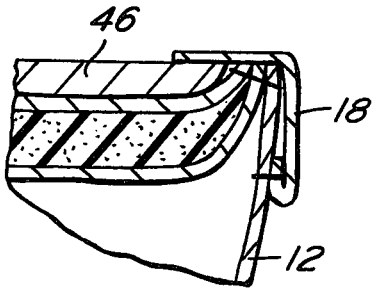
FIG. 13
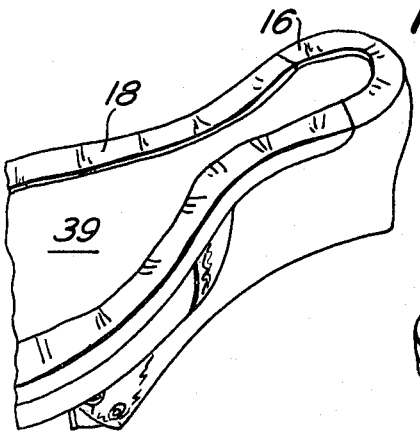
FIG. 14
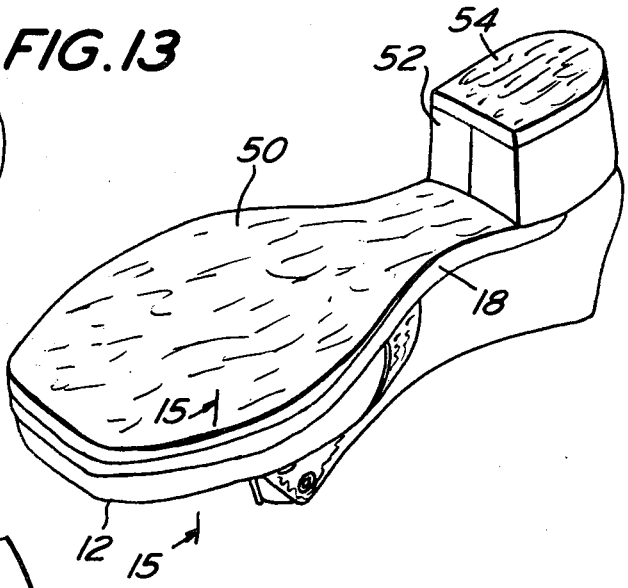
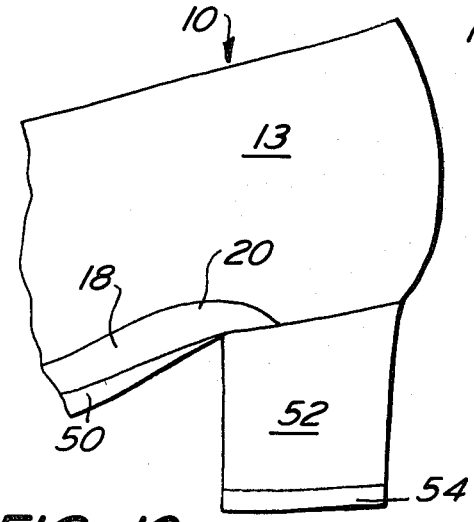
FIG. 16
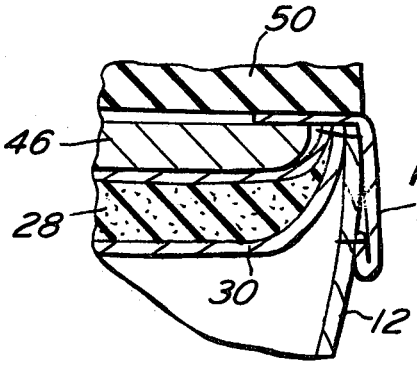
FIG. 15

METHOD OF MAKING SHOES

BACKGROUND

This invention relates to a method of making shoes. U.S. Pat. No. 3,344,537 is considered to be representative of the prior art.

DISCLOSURE

The method of the present invention includes the providing of an upper having a heel flange. A longitudinal edge portion of a mud guard is stitched to the upper and parallel to the lower edge of the upper. The major portion of the periphery of a preformed sock lining is then stitched to the lower edge of the upper.

Thereafter, an inner sole containing a metal shank is lasted to the exposed face of the sock lining. The free edge portion of the mud guard is folded over the inner sole and lasted thereto. The heel flange is then folded over the inner sole and lasted thereto. An outsole is then bonded in overlying relation to the inner sole and the overlying portions of the mud guard and heel flange. If desired, any type of heel may be applied by way of a heel attaching operation.

In a preferred embodiment of the present invention, the stitching which joins the sock lining to the upper does not join the sock lining to the heel portion of the upper. By leaving the back open, whereby there is no stitching between the sock lining and the back portion of the shoe upper, I obtained a very secure fastening of the back portion of the heel seat since all components thereof are lasted over said heel seat portion. This makes the back portion one solid unit with the option of using a variety of different counters. Counters that have a bottom flange for overlying the periphery of the last and for providing stability of the counter may be used. Thus, it is possible to use conventional heel seat lasting machines which are fast, efficient and provide a positive contour at the bottom and side of the last while achieving a uniform smoothness at the edge portions in a mass production operation.

In the preferred embodiment of the present invention, the wrapper extends beyond the arch to the heel portion of the upper with a graceful curve adjacent the heel flange. In this manner, the mud guard follows the outer periphery of the outsole and terminates at the heel portion. The width of the mud guard is preferably chosen in relation to the width of the heel flange so that they overlie the inner sole by substantially the same margin.

The shoes made in accordance with the present invention have an external appearance of being a conventionally lasted shoe while having internal comfort of a slip lasted construction. Other features and objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a shoe made in accordance with the present invention.

FIG. 2 is a perspective view of an upper preformed in an initial step of the present invention.

FIG. 3 is a perspective view showing a mud guard stitched to the upper.

FIG. 4 is a sectional view taken along the line 4—4 in FIG. 3.

FIG. 5 is a bottom perspective view of the shoe in a subsequent stage of construction.

FIG. 6 is a sectional view taken along the lines 6—6 in FIG. 5.

FIG. 7 is a perspective view of the shoe shown in FIG. 5 mounted on a last.

FIG. 8 is an exploded perspective view of a subsequent stage in the construction.

FIG. 9 is a bottom perspective view of a subsequent stage of construction.

FIG. 10 is a sectional view taken along the line 10—10 in FIG. 9.

FIG. 11 is a bottom perspective view of a subsequent stage of construction.

FIG. 12 is a sectional view taken along the line 12—12 in FIG. 11.

FIG. 13 is a partial bottom perspective view of a subsequent stage of construction.

FIG. 14 is a bottom perspective view of a completed shoe as shown in FIG. 1.

FIG. 15 is a sectional view taken along the line 15—15 in FIG. 14.

FIG. 16 is a partial side elevation view of the rear of the shoe shown in FIG. 1.

Referring to the drawing in detail, wherein like numerals indicate like elements, there is shown in FIG. 1 a shoe designated generally as 10 and made in accordance with the method of the present invention. The shoe 10 is preferably made from leather or plastic materials except as will be pointed out hereinafter.

A partially preformed upper is constructed as shown in FIG. 2 with a tongue 14 extending into the vamp portion of the upper and stitched thereto. The heel portion 13 of the upper includes a downwardly extending heel flange 16. The heel portion 13 includes a counter liner 17 with a counter 19 therebetween. The counter liner 17 and the heel portion 13 are joined to the upper by stitching 15.

A mud guard 18 is joined along one longitudinal edge to the upper 12 by stitching 20. See FIG. 4. It will be noted that the stitching 20 is located spaced from but parallel to the lower edge 22 of the upper 12. Further, it will be noted that the mud guard 18 is of sufficient length whereby it extends to and overlaps the heel flange 16 with a graceful curve in the stitching 20 and in the shape of the mud guard 18. See FIG. 3.

A sock lining 24 is preformed with one or more notches 25 or other indicator thereon. The notch 25 is a manufacturing aid in that it is adapted to be aligned with a mating notch or indicator 23 on the lower edge 22 of the upper 12.

The preformed sock lining 24 is preferably comprised of a plurality of layers 26, 28 and 30 joined together only at the heel portion by overcast stitching 34 and in the ball portion by a closed loop of stitching 36. If desired, the front edges may be joined by edge stitching. Layer 30 is preferably a layer of soft leather or plastic. Layer 28 is a layer of foam polymeric plastic material such a foam polyurethane. Layer 26 is preferably a layer of fabric such as canvas. The sock lining 24, which may be considered an insole, is joined to the lower edge 22 of the upper 12 by stitching 32. See FIGS. 5 and 6. Stitching 32 begins adjacent one end of the stitching 34 and terminates opposite the other end of the stitching 34 whereby the heel portion of the sock lining 24 is not joined to the heel portion 13 or the counter liner 17. This is shown more clearly in FIG. 7.

Referring to FIG. 7, a last 38 is slipped into the cavity formed by the union of the upper 12 to the sock lining 24. A platform or inner sole 39 is preformed. The inner sole 39 includes a rigid shaped metal shank 42 sandwiched between a rigid layer 40 of plastic or fiber material and a second layer. The second layer comprises portions 46 and 47 bonded together at line 48. Portions 46 and 47 are preferably fibrous material. The entire inner sole is cemented or otherwise bonded together.

In addition to the use of cement or other material to bond the components of the inner sole 39 together, a plurality of staples 44 have their bight portion between the layer 40 and the shank 42. The staples 42 extend through and provide a positive lock between the shank 42 and the portion 46. See FIGS. 9 and 10.

The inner sole 39 is lasted to the sock lininng 24 by use of cement, adhesive, or in any other desired manner. As pointed out above, the heel portion of the sock lining has not been secured to the heel portion 13 of the upper.

With the thusly constructed shoe 10 still on the last 38, the mud guard 18 is folded so as to extend upwardly for approximately the same distance as the heel flange 16 projects upwardly beyond the upper surface of the inner sole 39. Thereafter, the mud guard 18 is wiped into overlying relation and lasted to the peripheral portion of the inner sole 39. See FIG. 11. Thereafter, the heel flange 16 is wiped into overlying lasted relation to the inner sole 39. Conventional adhesives may be utilized to effect the bonding relationships illustrated in FIGS. 11–13. Thereafter, the thusly constructed shoe is taken off the last 38 and positioned onto a conventional heel attaching machine. The outsole 50 which may be of rubber, leather, plastic or other suitable material is bonded to the inner sole 39 and overlying portions of mud guard 18 and heel flange 16. The thickness of the outsole 50 is preferably thinner at the heel then in the remainder of the outsole 50. See FIGS. 14 and 15. Thereafter, a heel having a top lift 54 or any heel or wedge used in shoe manufacturing is attached to the thusly constructed shoe.

When using a counter having a bottom flange, the bottom flange is disposed between the heel portion of the sock lining 24 and the laminate 39. Alternatively, the counter may terminate flush with the lower edge of the counter liner 17 shown in FIG. 5.

Various alternatives will present themselves to those skilled in the art. For example, since stitching 20 and stitching 32 extend for approximately the same distance around the major portion of the periphery of the lower edge of the upper 12, a single line of stitching may be utilized in place of the stitching 20 and 32. The heel portion 13 of the upper may have decorative foxing, may be open, etc. Different styles of uppers 12 may be utilized as desired. The heel platform 52 may assume a wide variety of shapes known to those skilled in the art.

As will be apparent from the above, the shoe 10 has a slip lasted construction which permits the use of materials other than leather.

The present invention may be embodied in other specific forms without departing from the spirit or essential attributes thereof and, accordingly, reference should be made to the appended claims, rather than to the foregoing specification as indicating the scope of the invention.

I claim:

1. A method of making a shoe comprising the steps of providing an upper with a heel flange and counter lining, stitching a longitudinal edge portion of a mud guard to the upper adjacent the lower edge of the upper, attaching only a portion of the periphery of a sock lining to the upper adjacent the lower edge of the upper while leaving the heel portion of the sock lining free from attachment to the upper and counter lining, lasting an inner sole containg a metal shank to said sock lining, bonding the free edge portion of said mud guard to said inner sole in overlying relation thereto, lasting the heel flange to said inner sole in overlying relation thereto, and thereafter attaching an outsole to said inner sole.

2. A method in accordance with claim 1 wherein said step of stitching the mud guard to the upper includes locating the stitching parallel to the lower edge of the upper but spaced therefrom by a distance greater than the distance between said lower edge of the upper and the attachment means which secures the sock lining to the upper.

3. A method in accordance with claim 1 including using a preformed sock lining having a layer of foam polymeric material between upper and lower layers, and stitching the layers of the sock lining together only at the heel portion and at a closed loop of stitching in the ball portion before the sock lining is attached to the upper.

4. A method in accordance wiith claim 1 including using a mud guard of sufficient length so that it extends to a position wherein it overlies a portion of the heel flange, and the portion of the stitching between the mud guard and the upper adjacent the heel flange being arcuate.

5. A method in accordance with claim 1 which includes preforming the inner sole so that the metal shank is between and bonded to first and second layers and stapling one of said layers to the shank.

6. In a method of making a shoe having a slip lasted construction comprising the steps of stitching a mud guard to a lower periphery of an upper so that the ends of the mud guard terminate at a heel flange on the upper, preforming a sock lining having a layer of foam polymeric material sandwiched between upper and lower layers of material and joined together by a closed loop of stitching in the ball portion thereof, stitching the peripheral portion of said sock lining to the lower edge of said upper except for the heel portion of the sock lining.

7. In a method in accordance with claim 6 wherein said step of preforming the sock lining includes stitching the layers of the sock lining periphery only at the heel portion thereof.

8. In a method in accordance with claim 7 wherein said step of stitching the sock lining to the upper is accomplished at a location closer to the lower edge of the upper as compared with the location wherein the mud guard is stitched to the upper.

9. In a method in accordance with claim 6 including preforming an inner sole having a metal shank sandwiched between and bonded to first and second layers of different length, stapling the shank to the longer of the first and second layers, preforming the inner sole so as to have the size and shape corresponding generally to the size and shape of the sock lining, and lasting the inner sole to the sock lining with an adhesive cement.

10. A method in accordance with claim 9 including cementing an outsole to the inner sole while using an outsole whose thickness adjacent the location of the shank is thinner than the portion of the outside adjacent the ball.

11. A method in accordance with claim 6 including stitching the layers of said sock lining together at the heel portion and at the toe portion.

12. A method in accordance with claim 6 including matching at least one notch on the periphery of the sock lining with a mating notch on the periphery of the upper before said step of stitching the sock lining to the upper.

* * * * *